United States Patent [19]

Le Maoût et al.

[11] Patent Number: 4,668,167

[45] Date of Patent: May 26, 1987

[54] MULTIFUNCTION LABYRINTH SEAL SUPPORT DISK FOR A TURBOJET ENGINE ROTOR

[75] Inventors: Theophile F. Le Maoût, Vert Saint Denis; Marc R. Marchi, Le Mee sur Seine; Andre F. Ollivier, Brie Comte Robert, all of France

[73] Assignee: Societe National d'Etude et de Construction de Moteurs d'Aviation "S.N.E.C.M.A.", France

[21] Appl. No.: 890,341

[22] Filed: Jul. 29, 1986

[30] Foreign Application Priority Data

Aug. 8, 1985 [FR] France ..... 85 12142

[51] Int. Cl.[4] ..... F01D 5/18

[52] U.S. Cl. ..... 416/95; 416/220 R; 416/193 A

[58] Field of Search ..... 416/220 R, 193 A, 219 R, 416/95

[56] References Cited

U.S. PATENT DOCUMENTS

| | | | |
|---|---|---|---|
| 3,034,298 | 5/1962 | White | 60/39.66 |
| 3,644,058 | 2/1972 | Barnabei et al. | 416/219 X |
| 3,734,646 | 5/1973 | Perkins | 416/220 R |
| 3,748,060 | 7/1973 | Hugoson et al. | 416/220 R X |
| 3,761,200 | 9/1973 | Gardiner | 416/193 A X |
| 3,768,924 | 10/1973 | Corsmeier et al. | 416/220 R X |
| 3,832,092 | 8/1974 | Manharth | 416/220 R |
| 3,887,298 | 6/1975 | Hess et al. . | |
| 4,093,399 | 6/1978 | Glenn | 416/193 A X |
| 4,111,603 | 9/1978 | Stahl | 416/193 A X |
| 4,142,836 | 3/1979 | Glenn | 416/219 R X |
| 4,171,930 | 10/1979 | Brisken et al. | 416/193 A X |
| 4,192,633 | 3/1980 | Herzner | 416/193 A X |
| 4,505,640 | 3/1985 | Hsing et al. | 416/219 R X |

FOREIGN PATENT DOCUMENTS

| | | | |
|---|---|---|---|
| 2854629 | 6/1979 | Fed. Rep. of Germany | 416/220 R |
| 2164197 | 11/1972 | France . | |
| 2324873 | 9/1975 | France | 416/220 |
| 2286282 | 9/1975 | France . | |
| 2345605 | 10/1977 | France | 416/220 R |
| 2413542 | 9/1978 | France . | |

*Primary Examiner*—Everette A. Powell, Jr.
*Attorney, Agent, or Firm*—Bacon & Thomas

[57] ABSTRACT

A multifunctional labyrinth seal support disk for a turbojet engine rotor is disclosed which also serves to axially lock the rotor blades onto the rotor wheel. A radial support disk has a generally conical, labyrinth seal means extending from the disk in an upstream direction and a conical collar extending from the disk in a downstream direction. The collar has a generally annular bearing surface which bears against an upstream side of the rotor blade roots. Several blade-retaining teeth extend from the collar in a downstream direction and are dimensioned so as to fit within axial grooves between the blade root and the rotor blade wheel. Radially extending spurs bear against the downstream portion of the rotor blade root to axially lock the rotor blade onto the disk. An attaching ring is interposed between the blade retaining teeth and the rotor blade wheel so as to axially lock the multifunctional disk with respect to the rotor blade wheel.

7 Claims, 3 Drawing Figures

FIG.: 3
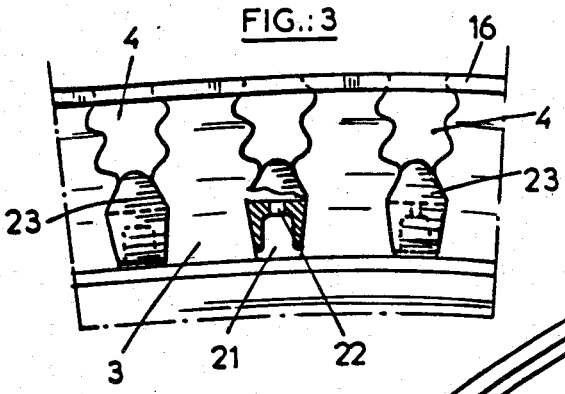
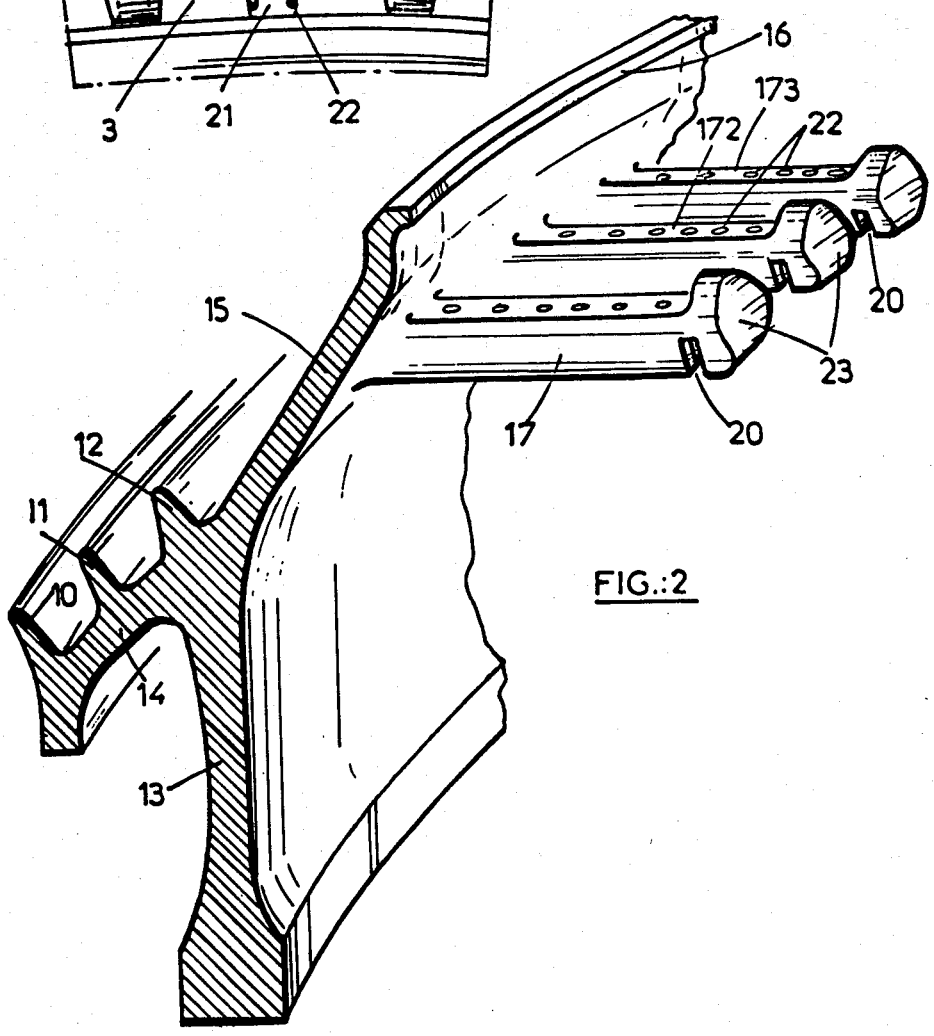
FIG.: 2

MULTIFUNCTION LABYRINTH SEAL SUPPORT DISK FOR A TURBOJET ENGINE ROTOR

BACKGROUND OF THE INVENTION

The present invention concerns a multifunctional labyrinth seal support disk for a turbojet engine rotor. As is well known in the art, turbojet engine and turbine rotor wheels typically define a plurality of axially extending grooves in the periphery which receive roots of the rotor blade.

In order to ensure the maximum operating efficiency of the turbojet engine, leakage of the gases passing over the rotor blades must be minimized. It is known to provide a labyrinth seal between a rotor wheel and an adjacent stator vane structure. The stator vanes are usually located upstream of the associated turbine wheel and serve to direct the flow of gases onto the rotor blades.

The axial grooves defined in the periphery of the rotor wheel typically have a "fir-tree" cross-sectional shape which corresponds to that of the root of the rotor blade such that, when the root is axially slid into the grooves, the interlocking grooves prevent any radial movement of the blade with respect to the wheel. Quite obviously, means must be provided to also prevent axial movement of the blade with respect to the rotor wheel. Many attempts have been made to simplify the attachment of the rotor blades and the labyrinth seals to the rotor wheels in order to achieve both a greater simplicity in assembly and improve resistance to the operational variations of the turbine. The operational variations of the turbine, especially a turbojet engine, tends to loosen the fastening means and, consequently, to increase the component wear, which, in turn, increases the dynamic imbalance of the engine. Typical of such attempts are the systems shown in U.S. Pat. Nos. 3,832,092 and 3,034,298.

French Pat. No. 2,324,873 discloses a system which utilizes an upstream flange and a downstream flange, each incorporating labyrinth seal means, to attach the rotor blades to the rotor wheel. The downstream flange also incorporates an annular portion having openings which are engaged by projections extending from the downstream end of the blade roots. Thus, the downstream flange prevents the rotor blade from moving in an upstream direction with respect to the rotor wheel, while the upstream flange locks the blades and prevents them from moving in a downstream direction with respect to the rotor wheel. The flanges are prevented from rotating by stubs which are kept in place by pins fixed in place by a seal component welded to the flange.

While this design has eliminated many of the drawbacks of the previous systems, it has achieved these results at the expense of simplicity. The numerous small parts, such as bosses and pins, coupled with the need for welding a seal component renders the initial assembly and any subsequent maintenance time consuming and expensive.

SUMMARY OF THE INVENTION

The object of the invention is to provide a support disk which not only supports the necessary labyrinth seal means, but which also serves to affix the rotor blades to the rotor blade wheel so as to prevent relative axial movement. The device consists of only two parts, the support disk and an attaching ring.

The radial support disk has a conical, labyrinth seal means extending from the disk in an upstream direction and a conical collar extending from the disk in a downstream direction. The collar defines a generally annular bearing surface which contacts an upstream side of the rotor blade roots and a plurality of blade-retaining teeth extending from the collar in a downstream direction. The blade retaining teeth are equal in number to the number of axial grooves formed in the rotor wheel and each tooth has an outwardly extending spur which is adapted to contact a downstream side of the blade root. The annular bearing surface and the radially outwardly extending spurs of the blade-retaining teeth serve to axially lock the blade root with respect to the support disk so as to prevent any relative movement in the axial direction.

An attachment ring extends in a generally radial direction between a groove defined in the outer periphery of the rotor wheel and a corresponding groove formed in each of the blade-retaining teeth. Each of the grooves in the teeth opens in a radially inward direction such that the grooves are axially aligned when the rotor blades and the support disk are properly assembled onto the rotor wheel. The attaching ring may be a resilient, split-ring which, when extending into the corresponding grooves prevents any axial movement between the support disk and the rotor wheel.

Other objects, features and advantages of the present invention will become more apparent in light of the following detailed description of the preferred embodiments as illustrated in the accompanying drawings.

BRIEF DESCRIPTION OF THE DRAWINGS

FIG. 2 is a partial perspective view, partially in section, showing the radial support disk of FIG. 1.

FIG. 3 is a partial view taken in the direction of arrow III in FIG. 1 showing the grooves formed in the rotor wheel.

DETAILED DESCRIPTION OF THE PREFERRED EMBODIMENTS

Figure 1:
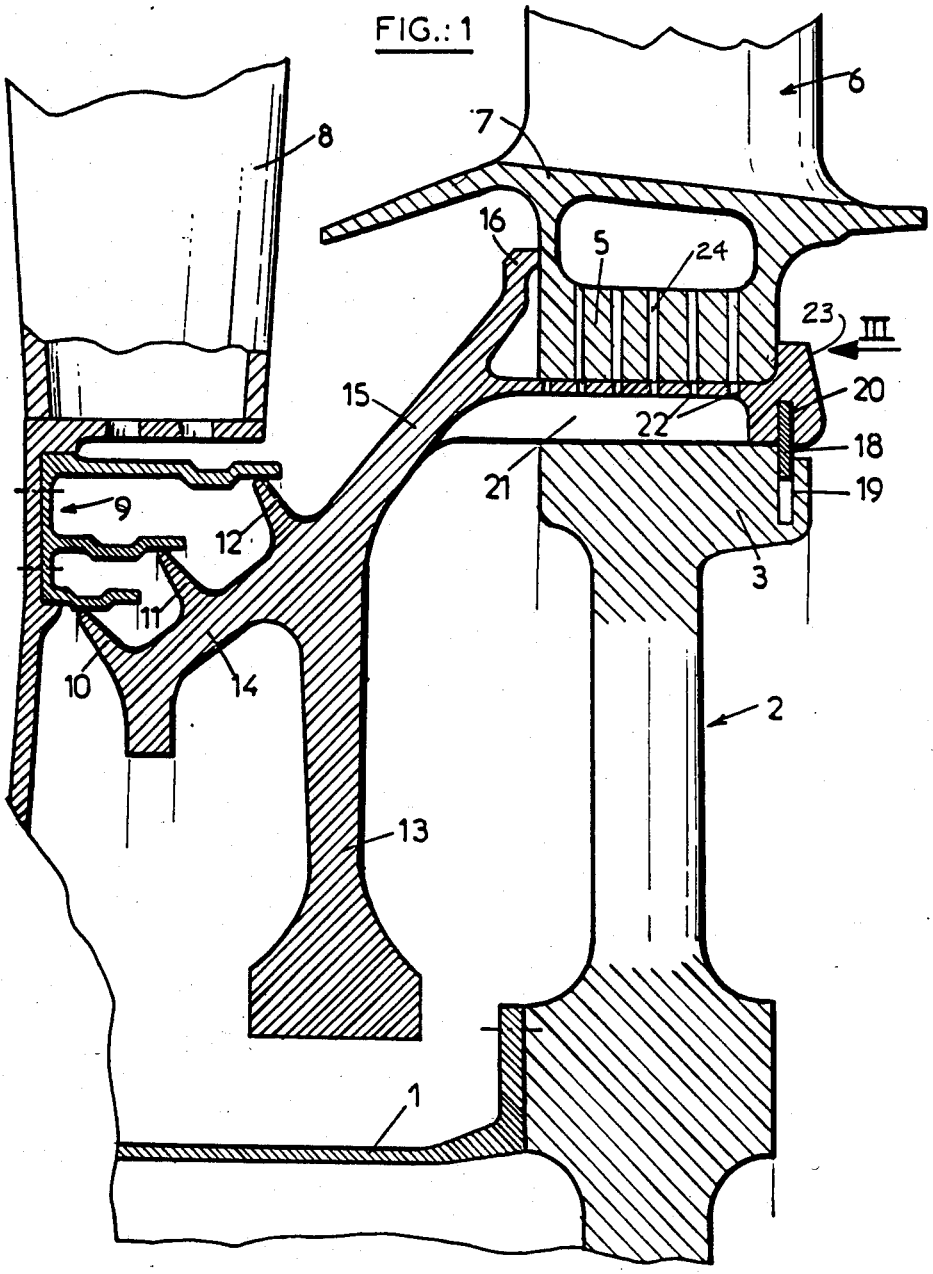
FIG. 1 is a partial, longitudinal sectional view of a turbine stage showing the rotor disk, the rotor blade, and the associated stator vane.

FIG. 1 is a partial view of a simplified section of a turbine stage of a turboject engine. A hollow shaft 1 of the turbojet engine is rigidly affixed to rotor wheel 2. Rotor wheel 2 has a peripheral rim 3 which defines a plurality of axial grooves 4 (see FIG. 3) having a "fir-tree" shaped cross-section as is well known in the art. Each of the grooves 4 receives the roots 5 of rotor blades 6. The cross-section of the blade roots 5 corresponds to the shape of the grooves 4 such that the interengagement of the grooves prevents any movement between the blade and the rotor wheel in the radial direction.

Each of the rotor blades may also have a platform 7 to provide aerodynamic continuity to the path over which the turbine gases flow. The gases are directed onto the blades 6 by a stator vane array, shown at 8 in FIG. 1. The stator vanes are attached to an outer casing of the turbine (not shown) in known fashion. The inner ends of the stator vanes 8 have one portion of a labyrinth seal 9 attached thereto. This portion may comprise a plurality of concentric cylindrical sleeves as illustrated in FIG. 1. Each of the cylindrical sleeves cooperates with fins 10, 11 or 12 so as to provide a labyrinth seal and to minimize the leakage of the gases therethrough.

The labyrinth seal fin 10, 11 and 12 according to this invention extend from a generally conical, labyrinth seal support ring 14 which extends in an upstream direction from radial support disk 13. Radial support disk 13 also has a generally conical collar 15 extending therefrom in a downstream direction. The conical collar 15 defines a generally annular bearing 16 at its downstream edge which is adapted to bear against an upstream portion of blade roots 5. A seal may be interposed between annular bearing 16 and the blade root 5 in order to establish a more positive seal between these elements.

A plurality of blade-retaining teeth 17 extend from the conical collar in a downstream direction. The number of such blade retaining teeth 17, 172, 173, etc., shown in FIG. 2, is equal in number to the number of grooves 4 defined by the rotor blade periphery 3. The circumferential spacing of the blade retaining teeth is such that each tooth 17 will slide axially within a groove 4 at the bottom of the groove, as illustrated in FIG. 3.

The distal downstream ends of each of the blade retaining teeth 17 define a radially outwardly extending spur 23 which bears against a downstream side of the associated blade root 5. The blade retaining teeth 17 also define a radially inwardly opening groove 20 which is axially aligned with a radially outwardly opening groove 19 formed in the peripheral rim 3 of rotor wheel 2.

As best seen in FIG. 1, an attaching ring 18 extends into both grooves 19 and 20 so as to positively prevent any relative movement between the support disk 13 and the rotor wheel 2. Attaching ring 18 may comprise a split ring formed of elastic or resilient material.

The assembly of the structure shown in FIG. 1 comprises the steps of placing the attaching ring 18 within groove 19 and placing radial support disk 13 adjacent rotor wheel 2 such that the distal ends of each of the blade-retaining teeth 17 just extend into each of the grooves 4. The blade roots 5 are then placed on each of the teeth 17 such that they bear against the annular surface 16 and the spurs 23. The blade roots 5 are also aligned with the grooves 4 and the entire assembly is then moved axially with respect to the rotor wheel 2 to achieve the position shown in FIG. 1. Since the attaching ring 18 is resilient, it will be deformed radially inwardly by the distal ends of each of the teeth 17 until groove 20 is aligned with groove 19. At this point, the attaching ring will return to its original shape so as to extend into both grooves 19 and 20.

In order to disassemble this structure, the attaching ring 18 is deformed radially inwardly and the support disk, along with the blade roots 5 are pulled axially out of the rotor wheel 2.

Each of the blade retaining teeth 17 may define an axially extending, radially inwardly opening groove 21 extending partially along its length. Passages 22 serve to connect the interior of groove 21 with one or more cooling passages 24 defined in blade root 5. This allows cooling air to circulate upwardly through the teeth 17 and into the blade root 5.

The multipurpose disk according to the invention serves to lock the blades and to keep them from moving axially with respect to the rotor wheel, while at the same time providing support for the labyrinth seal means and to provide means for supplying cooling air to the blades. The bearing 16 also serves to dampen any blade vibration during operation of the turbine.

The foregoing is provided for illustrative purposes only and should not be construed as in any way limiting this invention, the scope of which is defined solely by the appended claims.

What is claimed is:

1. In a turbine structure having at least one rotor wheel rotatable about an axis, a peripheral portion of the rotor wheel defining a plurality of axial grooves and a plurality of rotor blades having blade roots attached to the rotor wheel in the axial grooves, the improvements comprising:

(a) a radial support disk having:

(i) labyrinth seal means extending from the disk in an upstream direction;

(ii) a conical collar extending from the disk in a downstream direction, the collar defining a generally annular bearing surface adapted to contact an upstream side of the blade roots; and, (iii) a plurality of blade-retaining teeth extending in a downstream direction from the conical collar, the number of teeth being equal to the number of axial grooves, each of the teeth defining a radially outwardly extending spur adapted to contact a downstream side of the blade roots; and, (b) attachment means attaching the blade retaining teeth to the rotor wheel so as to prevent relative axial movement between the support disk and the rotor wheel.

2. The improved turbine structure according to claim 1 wherein the blade-retaining teeth are dimensioned to fit within the axial grooves.

3. The improved turbine structure according to claim 2 wherein each of the blade-retaining teeth extend between a blade root and the rotor wheel.

4. The improved turbine structure according to claim 2 wherein the attachment means comprises:

(a) a first slot defined by the rotor wheel opening in a radially outwardly direction;

(b) a second slot defined by the blade-retaining teeth and opening in a radially inwardly direction, the second slot located so as to be axially aligned with the first slot when the support disk is assembled with the rotor wheel, and, (c) a resilient split-ring member extending into the first and second slots.

5. The improved turbine structure according to claim 4 wherein each blade root defines at least one cooling air passage and further comprising:

(a) an axially extending, radially inwardly opening groove defined by each of the blade-retaining teeth; and, (b) at least one air passage defined by each of the blade-retaining teeth, the air passage being aligned with the at least one cooling air passage defined by the associated blade root to permit air flow between the axial groove and the cooling air passage in the blade root.

6. The improved turbine structure according to claim 1 wherein each blade root defines at least one cooling air passage and further comprising:

(a) an axially extending, radially inwardly opening groove defined by each of the blade-retaining teeth; and, (b) at least one air passage defined by each of the blade-retaining teeth, the air passage being aligned with the at least one cooling air passage defined by the associated blade root to permit air flow between the axial groove and the cooling air passage in the blade root.

7. The improved turbine structure according to claim 1 wherein the labyrinth seal means and the conical collar are integrally formed with the support disk.

* * * * *